US005586944A

United States Patent [19]

Nagamoto et al.

[11] Patent Number: 5,586,944

[45] Date of Patent: Dec. 24, 1996

[54] GOLF CLUB HEAD

[75] Inventors: Itsushi Nagamoto; Noburo Sumikawa; Tatsuya Hirakawa; Tatsuo Nakanishi, all of Shizuoka-ken, Japan

[73] Assignee: Yamaha Corporation, Japan

[21] Appl. No.: 550,276

[22] Filed: Oct. 30, 1995

Related U.S. Application Data

[63] Continuation of Ser. No. 895,210, Jun. 8, 1992, abandoned, which is a continuation of Ser. No. 648,598, Jan. 31, 1991, abandoned.

[30] Foreign Application Priority Data

| | | | |
|---|---|---|---|
| Feb. 1, 1990 | [JP] | Japan | 2-23240 |
| Mar. 31, 1990 | [JP] | Japan | 2-86461 |

[51] Int. Cl.[6] ..... A63B 53/02

[52] U.S. Cl. ..... 473/248; 473/310

[58] Field of Search ..... 473/246, 247, 473/248, 324, 333, 334, 341, 344, 345, 349, 305, 307, 308, 310

[56] References Cited

U.S. PATENT DOCUMENTS

| | | | |
|---|---|---|---|
| 1,249,127 | 12/1917 | Lard | 273/167 K |
| 1,574,213 | 2/1926 | Tyler | 273/80.2 |
| 1,575,364 | 3/1926 | Hodgkins | 273/80.2 |
| 2,203,893 | 6/1940 | Chapman | 273/80.2 |
| 2,705,147 | 3/1955 | Winter | 273/167 R |
| 3,191,936 | 6/1965 | Guier | 273/80.1 |
| 3,640,534 | 2/1972 | Mills | 273/167 K |
| 3,819,181 | 6/1974 | Mills | 273/167 K |
| 4,624,460 | 11/1986 | Murase at al. | 273/167 H |
| 4,630,827 | 12/1986 | Yoneyama | 273/169 |
| 4,632,400 | 12/1986 | Boone | 273/167 K |
| 4,667,963 | 5/1987 | Yoneyama | 273/169 |
| 4,699,383 | 10/1987 | Kobayashi | 273/169 |
| 4,874,171 | 10/1989 | Ezaki et al. | 273/167 H |
| 5,000,454 | 3/1991 | Soda | 273/167 H |

FOREIGN PATENT DOCUMENTS

| | | | |
|---|---|---|---|
| 51-110662 | 9/1976 | Japan . | |
| 60-30258 | 3/1985 | Japan . | |
| 3005767 | 1/1988 | Japan | 273/167 R |
| 371974 | 5/1932 | United Kingdom | 273/167 K |
| 2197209 | 5/1988 | United Kingdom | 273/167 R |

*Primary Examiner*—Steven B. Wong

*Attorney, Agent, or Firm*—Strolenk, Faber, Gerb & Soffen, LLP

[57] ABSTRACT

In construction of a wood type golf club head, its main body made of a material unsuited for plastic deformation such as FRP and its and hosel made of a material suited for plastic deformation such as metal are separably coupled to each other. Subtle adjustment of ball striking characteristics such as loft and lie angles can be practiced quite freely independently of the material used for the main body.

3 Claims, 4 Drawing Sheets

GOLF CLUB HEAD

This is a continuation of application Ser. No. 07/895,210, filed Jun. 8, 1992, now abandoned, which was a continuation of application Ser. No. 07/648,598, filed Jan. 31, 1991, now abandoned.

BACKGROUND OF THE INVENTION

The present invention relates to a golf club head, and more particularly relates to improvement in adjustability and ball striking characteristics of a shell type wood golf club head.

Joining a long period golf tournament, golfers usually practice subtle adjustment on condition of their golf club heads such as adjustment of lie angles and/or loft angles.

In the case of a metal club head such as an iron club head in which its hosel is formed in one body with its main body made of a metallic material, golfer's adjustment is carried out by bending the hosel with special jigs. In the case of a wood club head in which its main body is made of a wood material, golfer's adjustment is carried out by cutting the face of the main body to change its loft angle.

In the case of a shell type golf club head in which its main body is made of a fiber reinforced plastic shell (hereinafter referred to as an FRP shell), high mechanical strength and elastic nature inherent to its material does not allow easy bending of the hosel and/or easy cutting of the main body face for adjustment of conditions such as the lie angle and/or loft angle.

In construction of a conventional wood type golf club head made of wood, its main body has a one body construction. In particular, its hosel used for connection of the main body to the shaft is formed integrally of other parts on the main body such as a face, a sole, a crown and a back. Because of such an integral construction, the hosel is much vulnerable to mechanical damages to easily develop cracks therein. In order to cover this deficiency, the hosel is required to have a thick construction which naturally causes high position of the center of gravity of the club head. In the case of a conventional wood type golf club head made of metal, the relatively heavy construction of its hosel also causes high position of the center of gravity of the entire club head. When the main body is formed of an FRP shell, presence of reinforcing fibers in its hosel lowers percent void of the entire club head, thereby marring ball striking characteristics of the face on the main body. In addition, the shell construction does not allow easy deformation of the hosel for adjustment on condition of the golf club head.

SUMMARY OF THE INVENTION

It is the basic object of the present invention to raise the adjustability and ball striking characteristics of a shell type wood club head.

In accordance with the present invention, a shell type main body is made of a material unsuited for plastic deformation and a hosel separably coupled to the main body is made of a material suited for plastic deformation.

DESCRIPTION OF THE PREFERRED EMBODIMENTS

Figure 1:
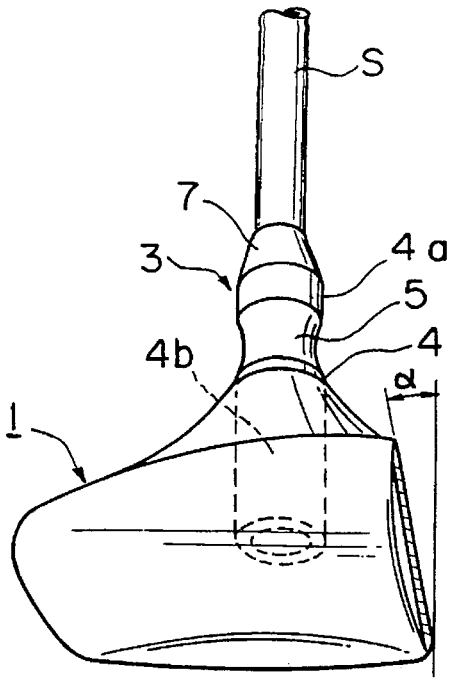
FIG. 1 is a front view of one embodiment of the golf club head in accordance with the present invention.
Figure 2:
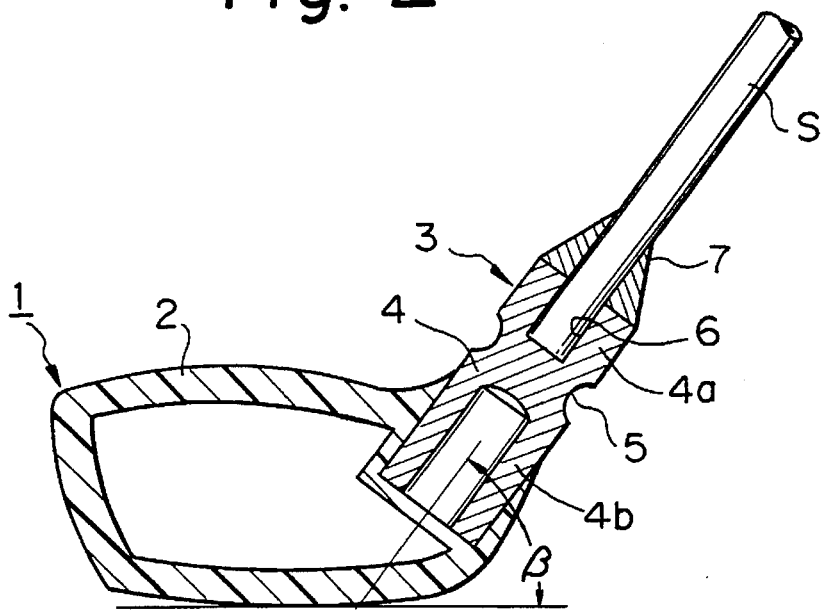
FIG. 2 is a sectional side view of the golf club head.

One embodiment of the golf club head in accordance with the present invention is shown in FIGS. 1 and 2, in which a main body 1 has a one body construction formed of an FRP shell 2 unsuited for plastic deformation and a hosel 3 coupled as later described in detail to the main body 1 is made of a metallic material such as a brass or stainless steel suited for plastic deformation.

The hosel 3 is given in the form of a metallic sleeve 4 made up of two sections. One section **4*b* is embedded in the main body 1 whereas the other section 4*a* is exposed out of the main body 1 and the exposed section 4*a* is provided with an annular neck 5**.

Figure 3:
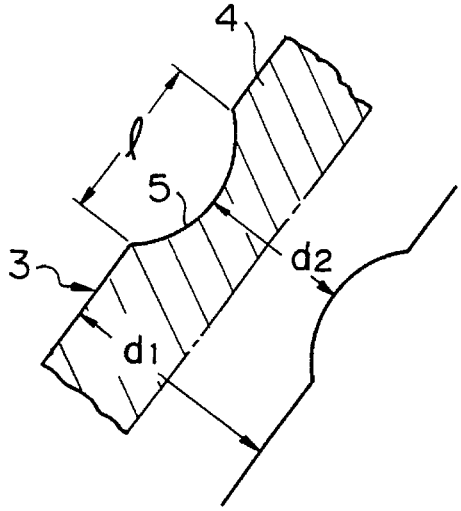
FIG. 3 is a sectional enlarged view of a part of the golf club head.

The portion of the sleeve 4 bearing the neck 5 is given in the form of a concave recess shown in FIG. 3 in order to allow easy bending for adjustment of its loft and lie angles "α" and "β". More specifically, the diameter "d1" of the metallic sleeve 4 decreases continuously to the minimum value "d2" within the range of the width "1" of the neck 5. Preferably, the two diameter values have the following relationship.

$$d2=d1\times(0.5\sim0.8)$$

The width "1" of the neck 5 should preferably be in a range from 3 to 10 mm, the diameter of the sleeve 4 should preferably be in a range from 11 to 14 mm and the length of the sleeve 4 should preferably be in a range from 30 to 50 mm. The length of the embedded section **4*b* of the sleeve 4** should preferably be in a range from 20 to 35 mm.

A bore 6 is formed axially in the metallic sleeve 4 in order to accommodate the lower end of a shaft S. For stable coupling of the shaft S and safety of the metallic sleeve 4, a protector cap 7 is attached to the top end of the metallic sleeve 4.

The FRP shell 2 has a high rigidity with low specific gravity. The reinforcing fibers are used in the form of a roving, a plain weave cloth, a twill weave cloth, a bias cloth or a mixture thereof. Carbon fibers, glass fibers, silica, boron fibers, aramide fibers or mixtures thereof are used for reinforcement. The fibers are impregnated preferably with unsaturated polyester resin or epoxy acrylate resin. The thickness of the shell is preferably in a range from 4 to 12 mm.

For formation of the hosel 3 the metallic sleeve 4 may be placed in a mould for production of the main body 1. Alternatively, a bore may be drilled into the main body 1 after its moulding for subsequent insertion of the metallic sleeve 4.

Metals of high specific elasticity are preferably used for the metallic sleeve. For example, iron type metals, Al alloys and Ti alloys are preferably used.

For tighter coupling of the main body 1 with the sleeve 4, two or more necks 5 may be formed in the embedded section **4*b*, one being located in the exposed section 4*a*. For same purposes, proper surface treatment may be applied to the embedded section 4***b* or small indentations may be formed in the surface of the embedded section 4*b*. The size of such indentations may be in a range from 0.2 to 2.0 mm.

Figure 4:
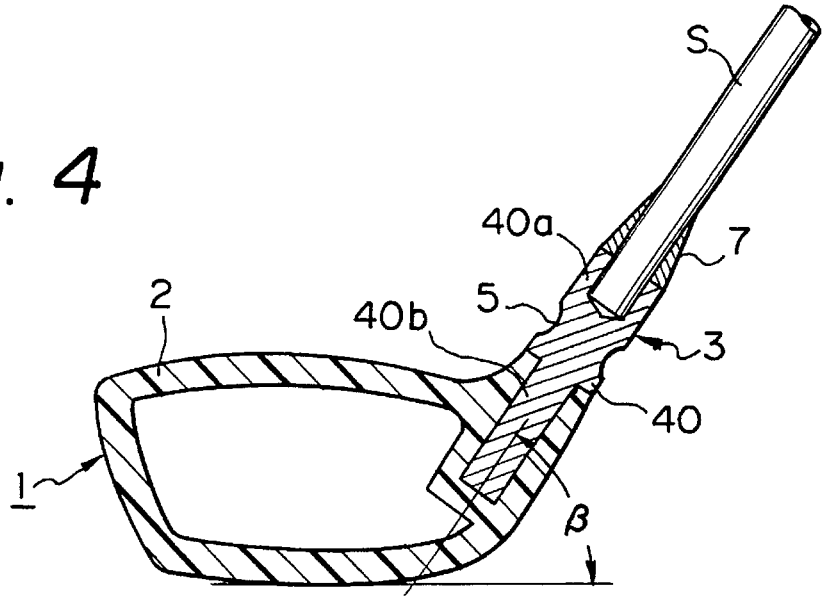
FIG. 4 is a sectional side view of a modification of the golf club head shown in FIG. 1.

FIG. 4 depicts another embodiment of the golf club head in accordance with the present invention, in which, as a substitute for the sleeve 4, the hosel 3 is formed of a metallic rod 40 provided at its exposed section 40*a* with a neck 5. The rod 40 further has an embedded section 40*b* inserted into and bonded to a bore formed in the FRP shell 2.

In accordance with the present invention, the hosel of a club head is made of a metallic material suited for plastic deformation and, as a consequence, the hosel can be deformed freely for adjustment of its loft and lie angles despite use of a shell type main body to which the hosel is separably coupled.

Figure 5:
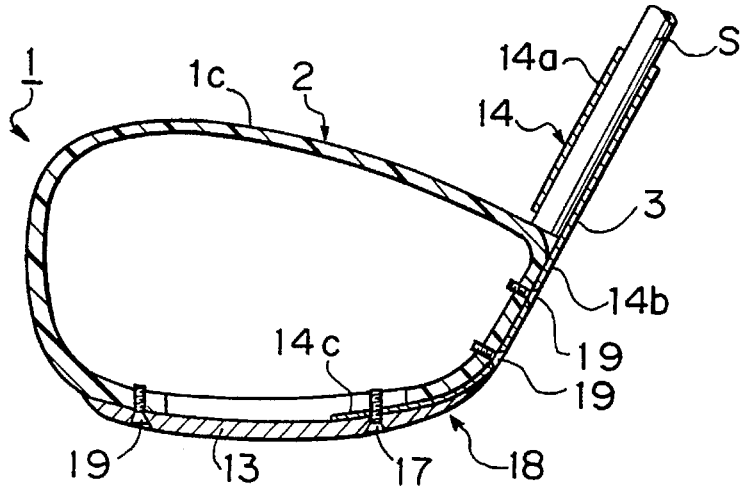
FIG. 5 is a sectional side view of another embodiment of the golf club head in accordance with the present invention.
Figure 6:
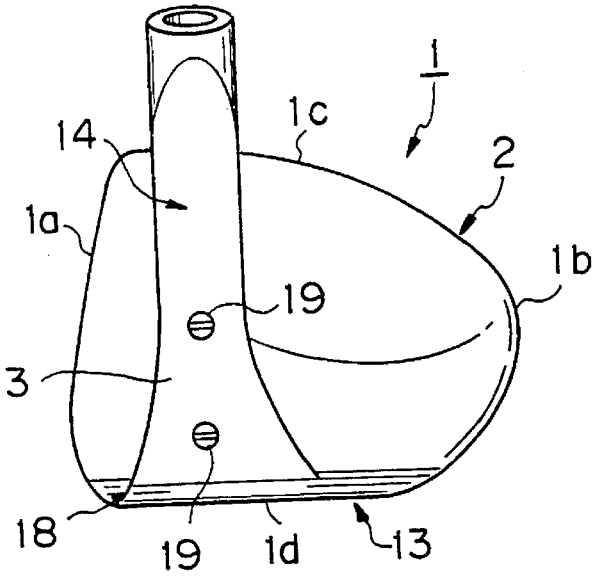
FIG. 6 is a rear view thereof.
Figure 7:
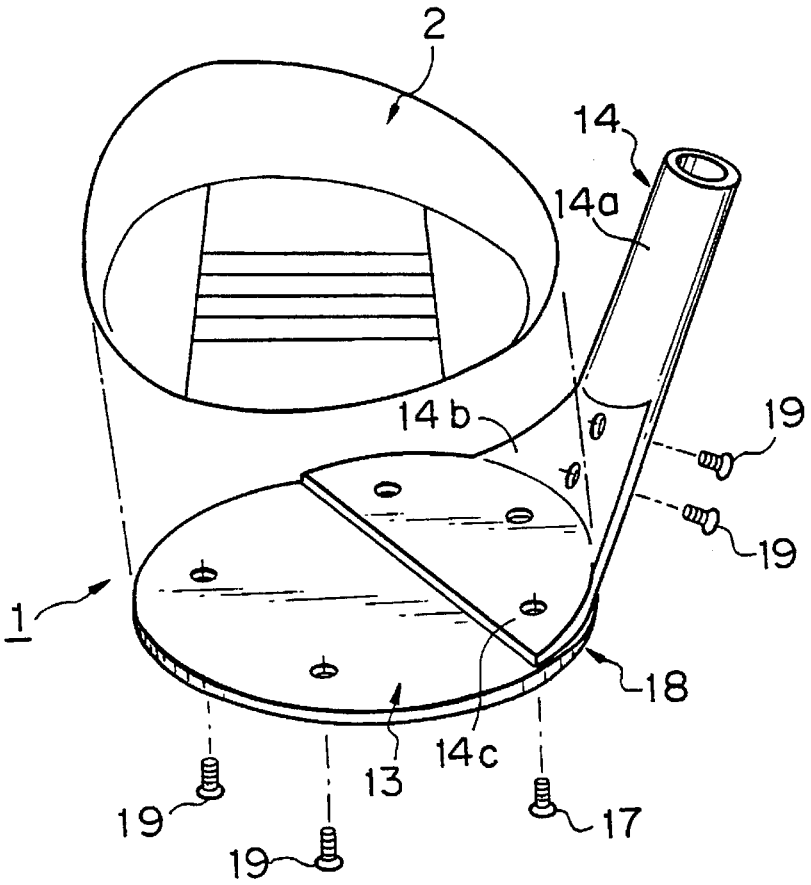
FIG. 7 is a perspective view of the golf club head in FIG. 5 in a disassembled state.

Another embodiment of the golf club head in accordance with the present invention is shown in FIGS. 5 to 7, in which the main body 1 is formed of an FRP shell 2 as in the foregoing embodiment and provided with a face 1*a*, a back 1*b*, a crown 1*c* and a sole 1*d*. In the case of this embodiment, the main body 1 is coupled to the shaft S via a connector unit 18 as hereinafter described in more detail.

More specifically, the connector unit 18 is made up of a sole piece 13 and a hosel piece 14 as best seen in FIG. 7. The sole piece 13 is made of a metallic material such as brass, stainless steel, Al or Ti and the hosel piece 14 is made Al, Ti or FRTP.

The hosel piece 14 is made up of a tubular section 14*a* and a tongue section 14*b* extending downwards from the tubular section 14*a*. The tongue section 14*b* can be bent freely for adjustment of its loft and lie angles. The lower end 14*c* of the tongue section 14*b* is somewhat bent and coupled to the sole piece 13 via screws 17 to form the connector unit 18. The FRP shell 2 is attached atop the connector unit 18 and fixed thereto via screws 19.

Figure 8:
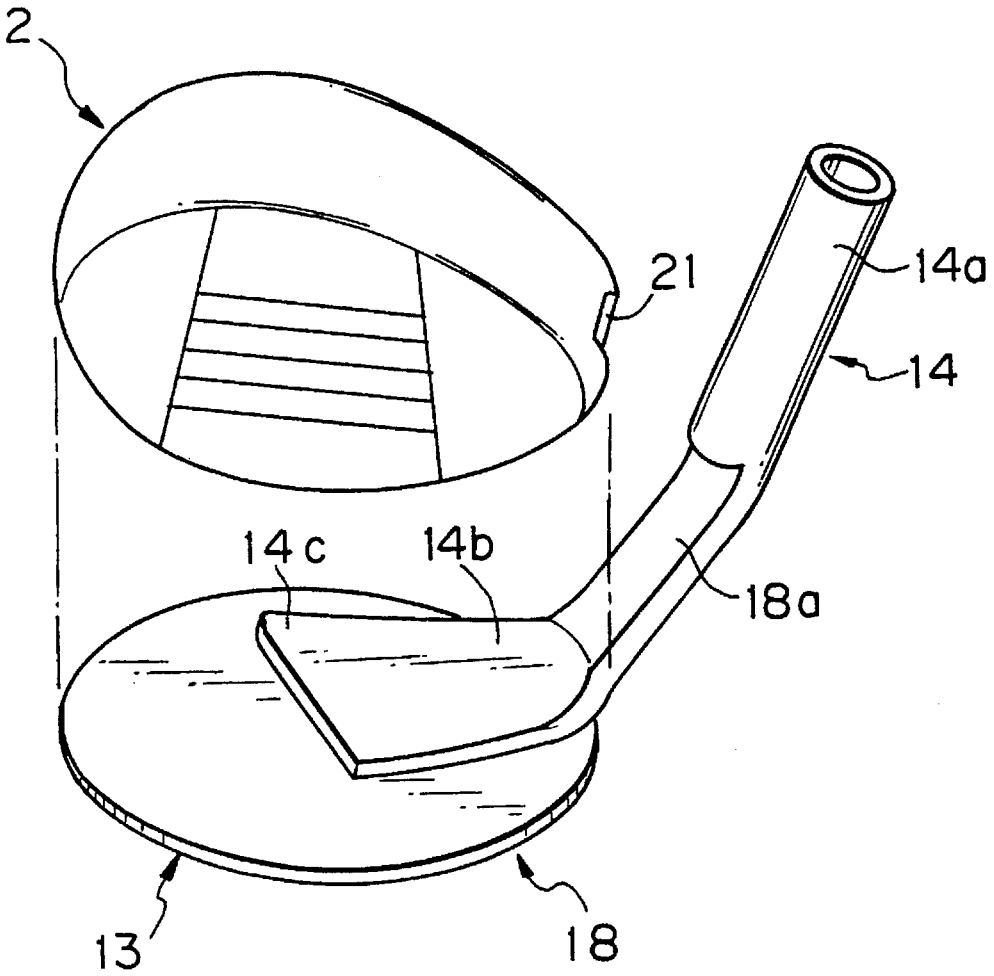
FIG. 8 is a perspective view of a modification of the golf club head shown in FIG. 5.

A slight modification is shown in FIG. 8 in which a depression 21 is formed in the tubular section 14*a* of the hosel piece 14 for tight engagement with a portion 18*a* of the connector unit 18.

In accordance with the present invention, the main body and the hosel are separably combined with each other and, as a consequence, the main body is allowed to have a high percent void independently of the construction of the hosel, thereby much improving ball striking characteristics of the club heady.

As well known, the distance between the center of the shaft and the face of a golf club is called face progression. A large face progression results in a high flying course of ball whereas a small face progression results in a low flying course of ball. In accordance with the present invention, the extent of this face progression can be adjusted quite freely, thereby assuring free choice in course of ball.

We claim:

1. A golf club, comprising: a shaft a shell type main body made of fiber reinforced plastic material unsuited for plastic deformation and having a toe side, a heel side and a sole;

a sole piece separably coupled to said sole of said main body; and a hosel having an upper tubular section for receiving the shaft as an angle with respect to said main body and a lower, easily deformable flattened tongue section adapted to contact said heel side of said main body externally of said main body and being separably coupled to said main body and to said sole piece, said shaft being received in said hosel such that said shaft does not extend into said tongue section and said hosel being made of a metal suited for plastic deformation such that said tongue section of said hosel may be easily deformed with said shaft in said upper tubular section of said hosel to change the angle between said shaft and said main body.

2. A golf club head as claimed in claim 1 in which said sole piece is made of a material taken from a group consisting of brass, stainless steel and Al, and said hosel is made of a material taken from a group consisting of Al, ti and stainless steel.

3. A golf club head as claimed in claim 1 in which said FRP shell is bonded to said sole piece.

* * * * *